US010390154B2

(12) United States Patent
Spearman et al.

(10) Patent No.: US 10,390,154 B2
(45) Date of Patent: Aug. 20, 2019

(54) METHOD AND APPARATUS FOR COIL ALIGNMENT IN ELECTROMAGNETIC HEARING IMPLANT

(71) Applicant: OTOTRONIX, LLC, Houston, TX (US)

(72) Inventors: Michael R. Spearman, The Woodlands, TX (US); Eric Hollnagel, Conroe, TX (US); Brian Spearman, The Woodlands, TX (US); Gabe Kern, Spring, TX (US)

(73) Assignee: Ototronix, LLC, Houston, TX (US)

( * ) Notice: Subject to any disclaimer, the term of this patent is extended or adjusted under 35 U.S.C. 154(b) by 0 days.

(21) Appl. No.: 14/392,118

(22) PCT Filed: Jun. 18, 2014

(86) PCT No.: PCT/US2014/042928

§ 371 (c)(1),
(2) Date: Dec. 17, 2015

(87) PCT Pub. No.: WO2014/205069

PCT Pub. Date: Dec. 24, 2014

(65) Prior Publication Data

US 2016/0183018 A1 Jun. 23, 2016

Related U.S. Application Data

(60) Provisional application No. 61/836,991, filed on Jun. 19, 2013.

(51) Int. Cl.
*H04R 25/00* (2006.01)
*H04R 9/04* (2006.01)

(52) U.S. Cl.
CPC ..... *H04R 25/658* (2013.01); *H04R 9/041* (2013.01); *H04R 25/55* (2013.01); *H04R 25/554* (2013.01);
(Continued)

(58) Field of Classification Search
CPC ..... H04R 25/658; H04R 25/60; H04R 25/65; H04R 25/652; H04R 2225/023; H04R 2225/025; H04R 2225/51; H04R 2460/15
(Continued)

(56) References Cited

U.S. PATENT DOCUMENTS 4,800,884 A 1/1989 Heide et al.
5,800,336 A 9/1998 Ball et al.
(Continued)

FOREIGN PATENT DOCUMENTS

EP 0354698 A2 2/1990
WO 2010000028 A1 1/2010
WO WO 2010000028 A1 * 1/2010 ..... H04R 25/658

*Primary Examiner* — Matthew A Eason
(74) *Attorney, Agent, or Firm* — Marshall & Melhorn, LLC

(57) ABSTRACT

A sound processor assembly having a coil support device which allows for the coil to be moved without damaging the plastic components or deforming the shell body. This is done by making the ear shell of the sound processor assembly, whether an integrated sound processor assembly or a linked sound processor assembly, out of two separate polymers: a first polymer that does not soften when heat is applied, and a second polymer which does. The first polymer is used for the first polymer zone of the shell which is shaped to the ear canal, while the second polymer is used for the section of the shell which supports the coil. This allows the shell to be heated, thereby softening the second polymer but not the first, and allows the coil to be repositioned to a new location.

15 Claims, 4 Drawing Sheets

(52) U.S. Cl.
CPC ..... *H04R 25/606* (2013.01); *H04R 25/65* (2013.01); *H04R 2225/025* (2013.01); *H04R 2225/51* (2013.01); *H04R 2225/67* (2013.01)

(58) Field of Classification Search
USPC ..... 381/324
See application file for complete search history.

(56) References Cited

U.S. PATENT DOCUMENTS

| | | | | |
|---|---|---|---|---|
| 6,359,993 | B2 | 3/2002 | Brimhall | |
| 6,393,130 | B1 * | 5/2002 | Stonikas | H04R 25/652 181/135 |
| 7,564,987 | B2 | 7/2009 | Aeschlimann et al. | |
| 2003/0161481 | A1 | 8/2003 | Miller et al. | |
| 2007/0100197 | A1 | 5/2007 | Perkins et al. | |
| 2007/0183613 | A1 * | 8/2007 | Juneau | A61F 11/10 381/322 |
| 2008/0063231 | A1 | 3/2008 | Juneau et al. | |
| 2008/0111283 | A1 | 5/2008 | Espersen et al. | |
| 2009/0232342 | A1 | 9/2009 | Oliveira et al. | |
| 2011/0144414 | A1 | 6/2011 | Spearman et al. | |
| 2015/0296314 | A1 * | 10/2015 | Nielsen | H04R 25/606 381/324 |
| 2016/0183018 | A1 * | 6/2016 | Spearman | H04R 25/65 381/324 |

* cited by examiner

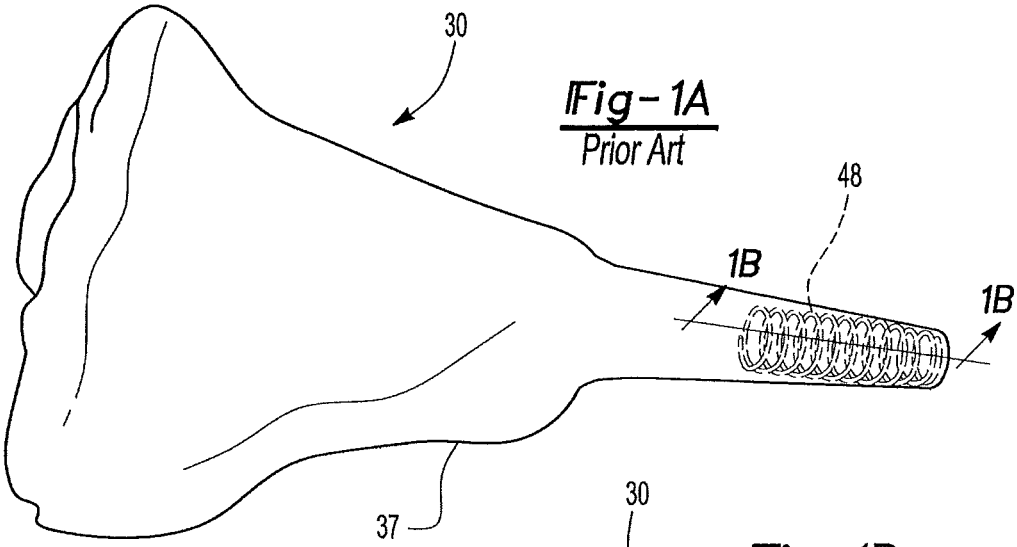
Fig-1A
Prior Art
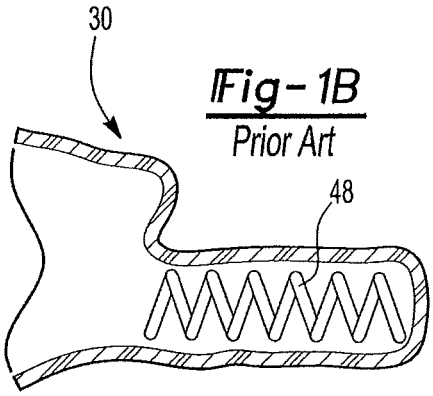
Fig-1B
Prior Art
Fig-2A
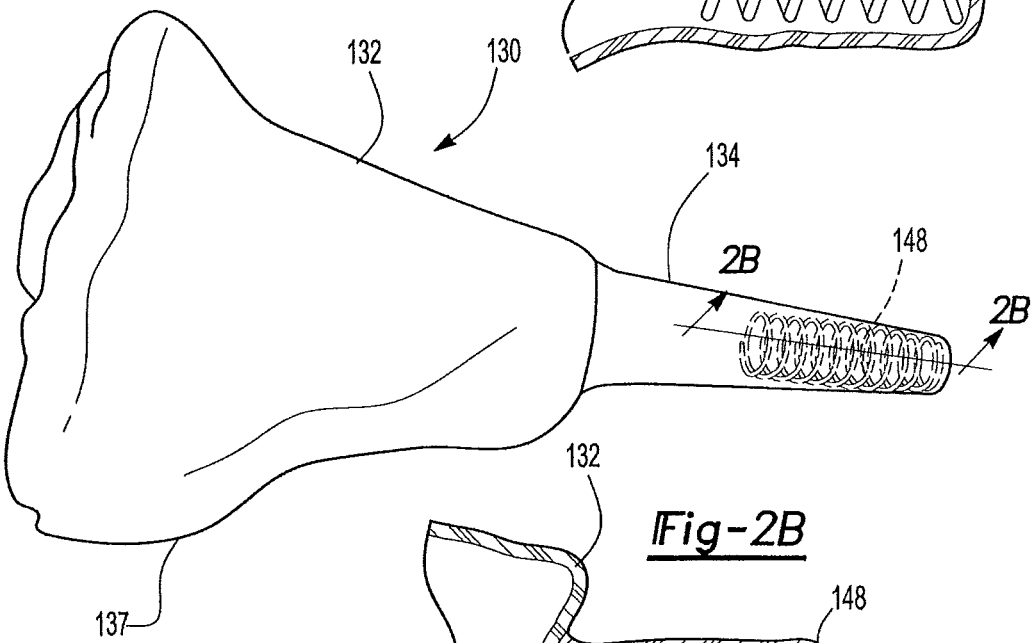
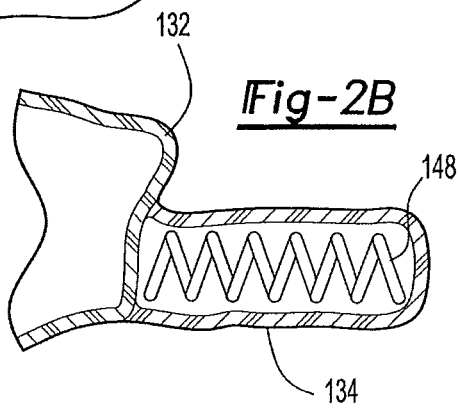
Fig-2B

METHOD AND APPARATUS FOR COIL ALIGNMENT IN ELECTROMAGNETIC HEARING IMPLANT

CROSS-REFERENCE TO RELATED APPLICATIONS

This application is claiming the benefit, under 35 U.S.C. § 119(e), of the provisional application filed Jun. 19, 2013 under 35 U.S.C. § 111(b), which was granted Ser. No. 61/836,991. This provisional application is hereby incorporated by reference in its entirety.

FIELD OF THE INVENTION

The present invention relates generally to the field of hearing. More particularly, the present invention relates to devices to improve hearing. Most particularly, the present invention relates to an improved method and apparatus for alignment of an energy or signal transmission device, such as an electromagnetic coil, and a transducer or driver, such as a magnet, in middle ear hearing systems.

BACKGROUND OF THE INVENTION

Many different reasons exist why some people have hearing impairment. As a general proposition, sound entering the outer ear canal does not get transmitted to the inner ear and/or transmitted to the auditory nerve. In many cases a middle ear device that creates vibrations is used to improve the hearing of such persons. One class of these middle ear devices are known as magnetic middle ear implant devices.

The solution to hearing problems caused by middle ear deficiencies may involve implanting a magnet in the middle ear or placing it on the eardrum and causing the magnet to vibrate in response to environmental sounds. The magnet is connected, for example, such that it provides mechanical vibrations to the oval window, either through an adequately functioning portion of the middle ear's ossicular chain to which the magnet is attached, or through an implanted prosthesis carrying the magnet and communicating with the oval window, round window, or other vibration conducting surface.

The magnet is usually caused to vibrate by placing it near to a coil of wire which is energized by the flow of electricity. Once such a coil of wire is energized by the flow of electricity, it becomes an "electromagnet" whose magnetic strength and polarity are based on the direction and strength of the electric current energizing it. If a permanent magnet is placed near this electromagnetic coil, the magnet will be attracted to, or repelled from, the coil.

However, if the implanted magnet is not optimally aligned with the external coil from which the electromagnetic signal propagates, the implanted magnet might not respond adequately. This is very important, as better patient outcomes will result with optimal magnet and coil alignment.

Even with advanced imaging technology, the final coil alignment may not end up in the optimal position. This results in reduced energy transmission to the magnet. In these cases, a new external sound processor may be made with the coil in a different position to try to achieve optimal alignment. In some cases, it may be necessary to make several external processors with different coil positions before the best coil location is finally achieved. This process of making multiple processor assemblies to arrive at the optimal alignment is expensive and requires many visits between the patient and clinician.

What is needed is a means for adjusting the position of the coil in the same device. One way to do this would be to be able to move the coil to a different position. However, the thermoset polymers which are used in ear mold shells are rigid and do not soften when heated. Consequently, they do not deform even when heat is applied and will ultimately crack if attempts are made to move the coil.

One consideration would be to make the shell out of a thermosoftening plastic, also known as a thermoplastic. Thermoplastics are polymers that become pliable or moldable above a specific temperature, and return to a solid state upon cooling. Most thermoplastics have a high molecular weight, whose chains associate through intermolecular forces; this property allows thermoplastics to be remolded because the intermolecular interactions spontaneously reform upon cooling. In this way, thermoplastics differ from thermosetting polymers, which form irreversible chemical bonds during the curing process; thermoset bonds break down upon melting and do not reform upon cooling. Examples of well-known thermoplastics are nylon (polyamide), polyethylene, polypropylene, acrylics, polystyrene, polyvinyl chloride, and Teflon. Thermoplastics are commonly used in well-known processes such as injection molding, blow molding, rotational molding, extrusion and thermoforming.

An advantage of using a thermoplastic for the shell would allow the shell material to soften when heated, which would allow for moving the coil to a new position. When the thermoplastic cools, it would once again regain a rigid state. However, the use of a thermoplastic shell is problematic for two reasons. First, even when heated, the material is very viscous and will not flow into a reverse mold without a significant amount of pressure. This would necessitate the use of much more expensive manufacturing processes to make the shell. The second problem with thermoplastics is that if the shell is heated to allow movement of the coil, then the shell itself would also be heated which would soften it and could result in deforming its shape such that it would not fit properly in the ear canal.

Because of the critical nature of the alignment, there continues to be a need in the art for a better method of aligning the magnet and coil.

SUMMARY OF THE INVENTION

The present invention provides for a sound processor assembly having a coil support device which allows for the coil to be moved without damaging the plastic components or deforming the shell body. This is done by making the shell of the sound processor assembly out of two separate polymers: a first polymer that does not soften when heat is applied, and a second polymer which does. Alternatively, the first polymer may soften at a higher temperature than the second polymer. The first polymer is used for the first polymer zone of the shell which is shaped to the ear canal, while the second polymer is used for the section of the shell which supports the coil. This allows the shell to be heated thereby softening the second polymer but not the first, and allows the coil to be repositioned to a new location. Once moved, the coil 48 is held in that position until the polymer cools back to a rigid state.

The second polymer portion may be connected with the shell by means of an adhesive, an overmolding process, a mechanical process such as a plug or screw connection, or any other process typically used in securing dissimilar plastic materials.

Also provided is an improved method for magnet and coil alignment which is usable once the magnet is implanted in the middle ear or placed on the eardrum of a patient, and a non-implanted electromagnetic transceiver coil needs to be aligned with the magnet. The non-implanted external device, which is typically referred to as the sound processor assembly, consists of one or more microphones, a sound processor, a battery and the transceiver coil.

This sound processor assembly sends electromagnetic signals which are picked up by the magnet which cause it to vibrate. Typically, the coil is located in the ear canal near the eardrum. In one embodiment, it may be an integrated part of the sound processor which resides in the ear canal. In another embodiment, the sound processor may be located behind the ear of the patient, and a connector link communicates to the coil located in the ear canal. In both cases, the coil must be held in a fixed position in the canal to communicate with the implant.

Once the magnetic implant has been attached to the ossicles in the middle ear, or on the eardrum, the external device must be made in such a way that the coil is aligned with the magnet. Ideally, the coil and the magnet should be aligned and as close together as possible. One method to do this provides for imaging the external ear canal, and then imaging the implant using imaging techniques well known in the art. Once this is done, the ear canal and implant images may be combined, and the external device may be built to fit in the ear canal with the coil being in optimal alignment with the implanted magnet.

After combining the ear canal and implant images, the coil placement may take place. Using the combined ear canal and implant model, the coil position is determined in 3D with respect to the implant axis for optimal axial alignment and distance within the ear canal space.

This may involve such steps as identifying the implant axis, locating the coil axis to the implant axis, adjusting the coil position along the axis to the optimal distance from the implant and insuring an acceptable clearance from the ear canal wall and the tympanic membrane or eardrum.

After the coil location is determined, the coil support device, which will fit in the ear canal and hold the coil in proper alignment, may be manufactured. This involves first manufacturing the in-the-canal ear mold shell which supports the coil. These may be of two types. The first type would be an integrated type having the sound processor, microphone and coil and any other electronics located within the shell.

The second type would be to have an in-the canal-mold shell with the coil. This is attached to a sound processor assembly located behind the ear, by a connecting link. The link may be a wire which transmits the electric signals from the sound processor to the electromagnetic coil. The link may also be a wireless design which transmits the signals from the processor to the coil.

BRIEF DESCRIPTION OF THE DRAWINGS

The above, as well as other advantages of the present invention will become readily apparent to those skilled in the art from the following detailed description when considered in the light of the accompanying drawings in which like numerals designate corresponding parts in the several views.

FIG. 1A is an illustration of the currently available prior art standard shell with a coil.

FIG. 1B is a sectional view, taken in the direction of the arrows, along the section line 1B-1B of FIG. 1A.

FIG. 2A shows an embodiment of the present invention wherein an improved IPC type sound processor assembly has a shell which is constructed of dual plastic zones having a first polymer and a second polymer.

FIG. 2B is a sectional view, taken in the direction of the arrows, along the section line 2B-2B of FIG. 2A.

Throughout the drawings, like elements are referred to by like numerals.

DESCRIPTION OF THE PREFERRED EMBODIMENTS

Figure 3:
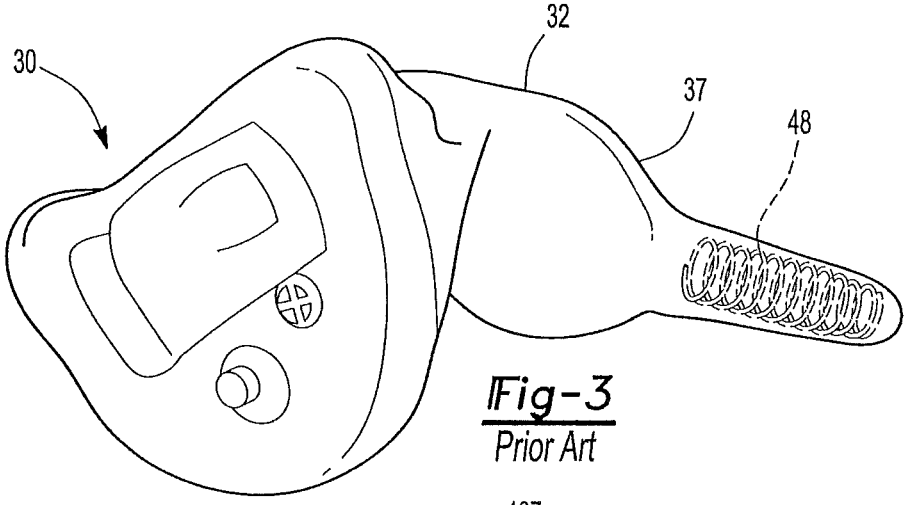
Fig-3 Prior Art
FIG. 3 shows a currently available integrated processor and coil (IPC).

Referring to FIGS. 1A and 1B, there is shown a currently available integrated processor and coil (IPC) sound processor assembly, generally designated by the numeral 30. The shell 37 is made entirely of a first polymer 32 which does not deform when heated, and has a coil 48 embedded therein.

Referring to FIG. 2 there is shown an embodiment of the present invention in the form of an improved IPC type sound processor assembly, generally designated by the numeral 130, and having an in the ear shell 137 having two polymer zones, a first polymer zone 132, and a second polymer zone 134, the second polymer zone acting as a coil support for the coil 148.

A second type of device would involve an integrated sound processor and coil (IPC) 30 being held in the ear canal by an in-the-canal mold shell 37 with a first polymer zone only designated by the numeral 32. An example of a currently available integrated processor and coil is shown in FIG. 3.

Figure 4:
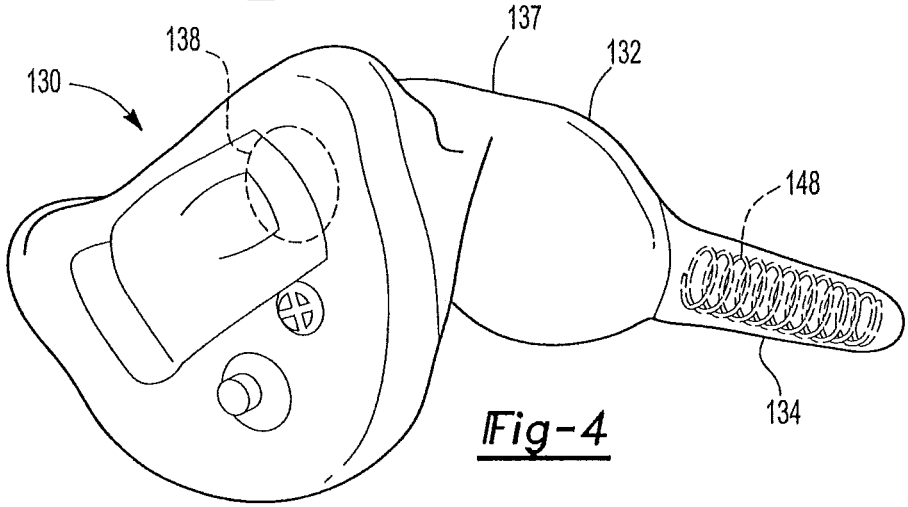
FIG. 4 shows an embodiment of the present invention having an improved IPC type sound processor assembly with a first polymer and a second polymer.

FIG. 4 is similar to FIG. 3, but showing an embodiment of the present invention with the improved sound processor assembly 130 having a first polymer zone 132 and a second polymer zone 134. A coil 148 is embedded in in the second polymer zone 134.

Figure 5:
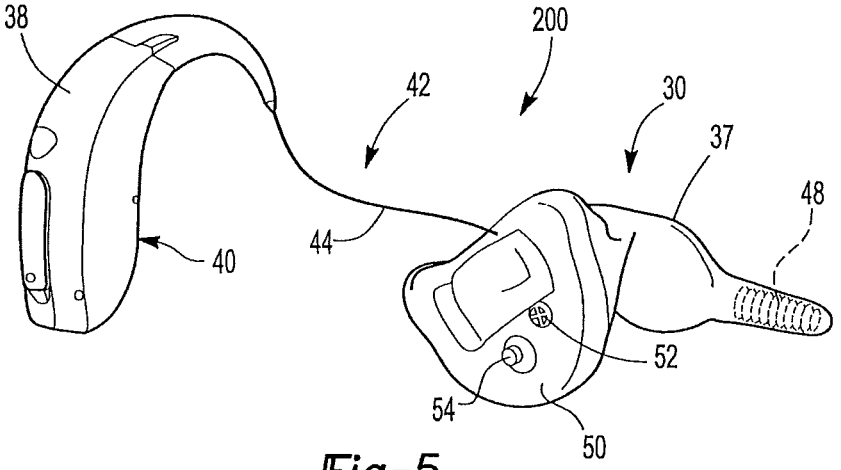
Fig-5 Prior Art
FIG. 5 shows a currently available linked processor and coil (LPC) wherein the processor is linked to the coil support device by a wire.

A third type of prior art device is the linked processor and coil (LPC) shown in FIG. 5, where the processor 38 is contained in a behind the ear (BTE) device 40 which is connected by a link 42, such as wire 44, to IPC 37.

Figure 6:
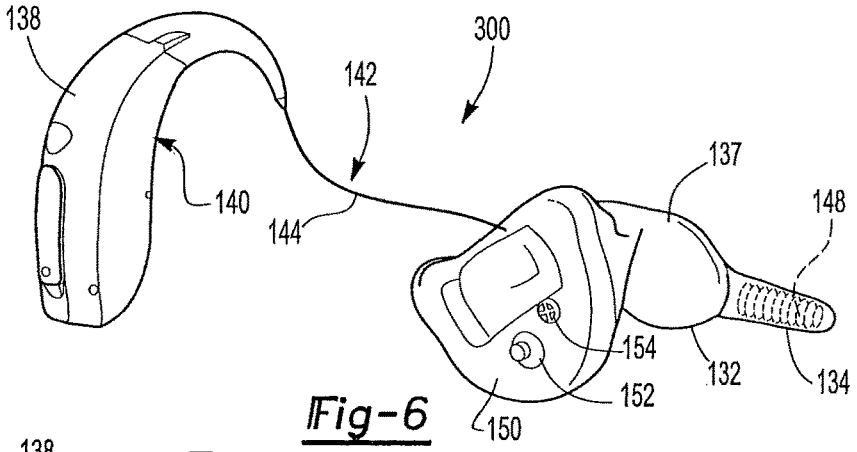
FIG. 6 shows an embodiment of the present invention having an improved LPC type sound processor assembly wherein the coil support device has a shell having a first polymer portion and a second polymer portion.

Another embodiment of the present invention is shown in FIG. 6. The improved sound processor assembly 300 has a shell 137 comprising a first polymer portion 132 and a second polymer portion 134. The coil 148 is contained in the second polymer portion of the shell 137. A behind the ear device 138, containing the sound processor 148 is connected by a link 142, such as wire 144, to the shell 137.

Figure 7:
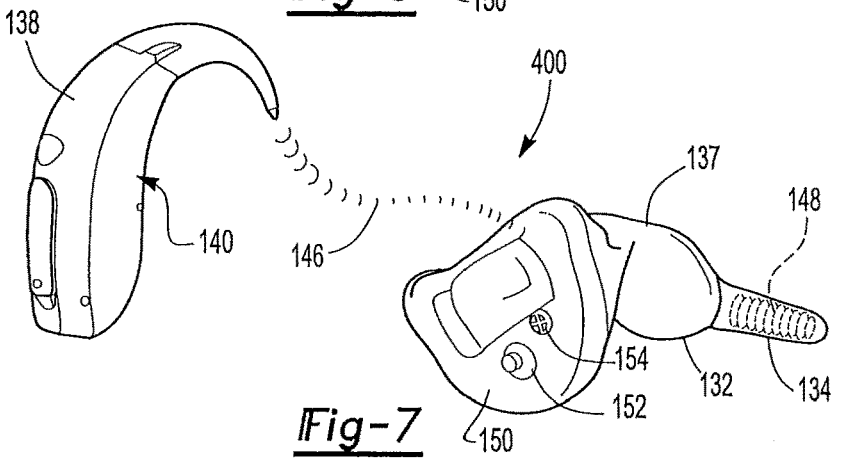
FIG. 7 shows a modification of the invention, similar in part to that shown in FIG. 6, but where the link is a wireless link.

A further embodiment of the present invention is shown in FIG. 7, wherein the improved sound processor assembly 400 has a behind the ear device (BTE) 140 containing the processor 138 connected by a wireless link 146 to the shell 137, which has a first polymer portion 132, and a second polymer portion 134.

Figure 8:
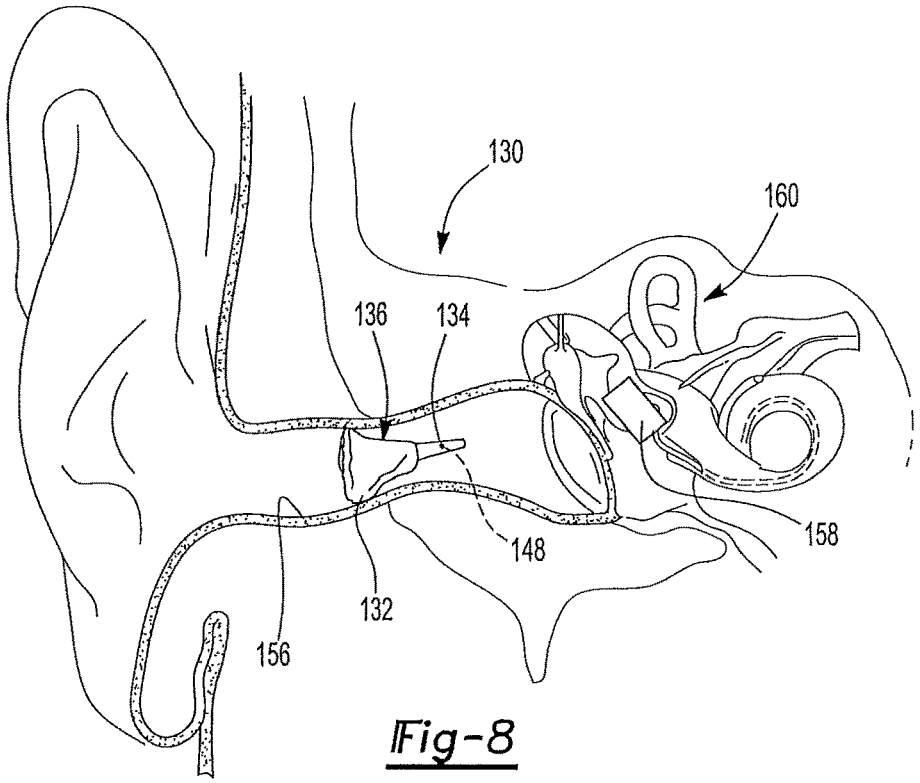
FIG. 8 illustrates the improved IPC type sound processor assembly of the present invention in the ear canal of a hearing aid user, and the coil activating a magnet on the ossicles of the user.

With reference to FIG. 8, the IPC type sound processor assembly 136 is shown placed in the ear canal 156 of the user. The coil 148 is made in the position to give optimum placement for aiming at the magnet 158 mounted to the ossicles 160 of the user of the device.

Figure 9:
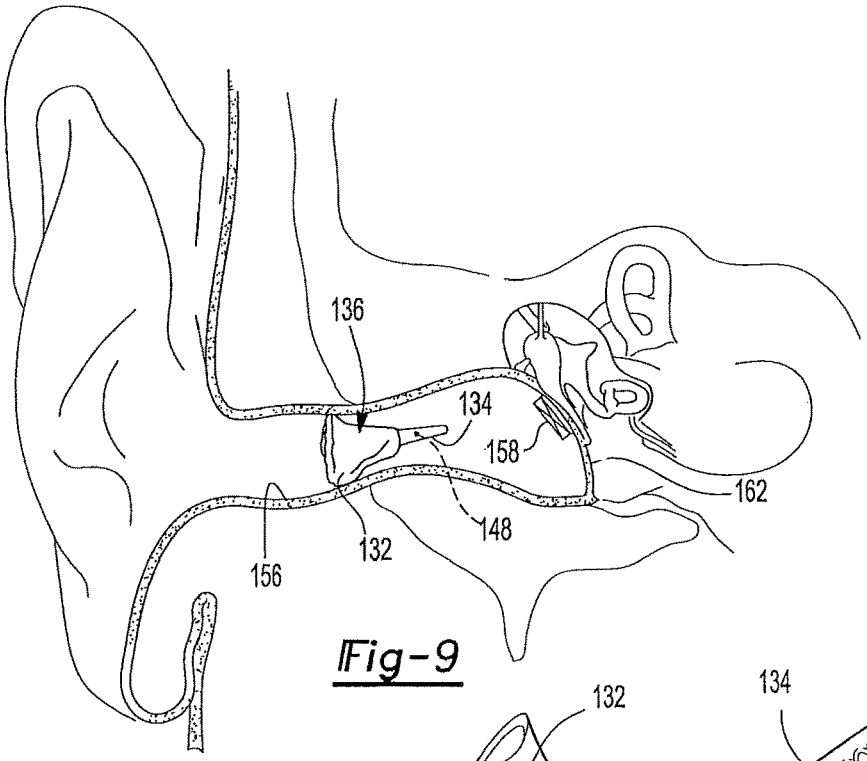
FIG. 9 is a view in large part similar to FIG. 8, but showing a magnet on the eardrum of the user.

In FIG. 9, the sound processor assembly 136 is shown placed in the ear canal 156 of the user. The coil 148 is made in the position to give optimum placement for aiming at the magnet 158, which in this embodiment of the invention is placed on the eardrum 162 of the user of the device.

Figure 10:
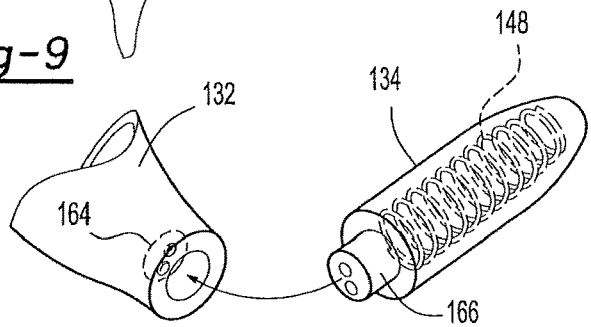
FIG. 10 is a partially cut away view of the improved IPC type sound processor assembly of the present invention wherein the first polymer zone has an electrical socket molded therein, and the second polymer zone has an electrical plug molded therein.
Figure 11:
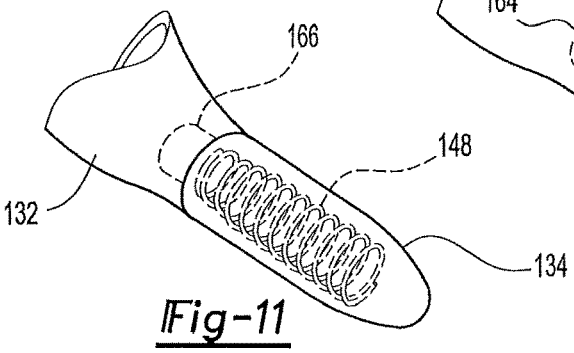
FIG. 11 shows the device of FIG. 10 with the first polymer zone plugged into the second polymer zone.

Referring to FIGS. 10 and 11, an electrical connection socket 164 may be secured in the first polymer zone 132 of shell 137, with the second polymer zone 134 of the shell 137 having a mating electrical connection or plug 166 which can be "plugged" into the socket 164.

Figure 12:
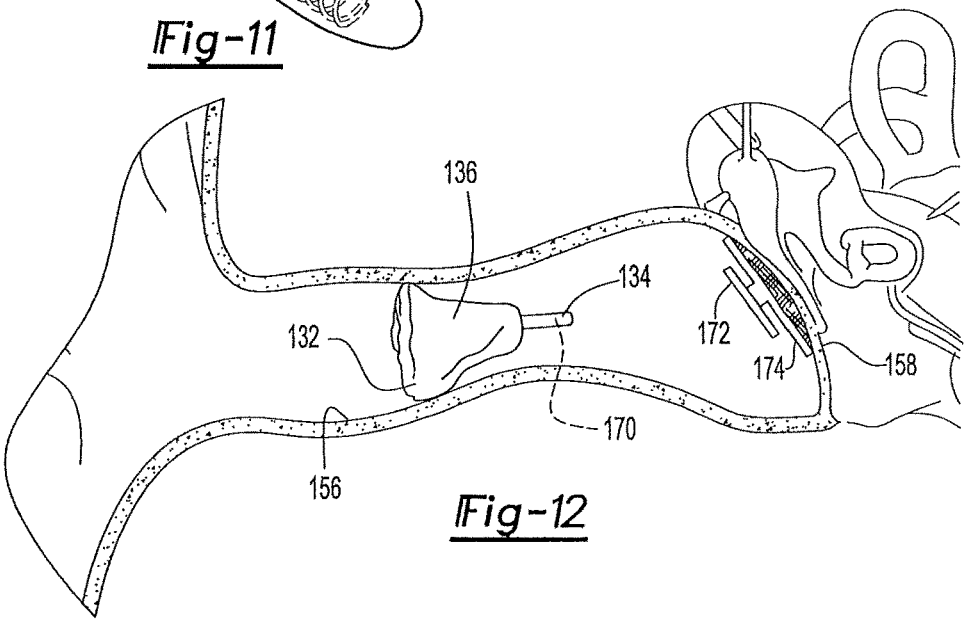
FIG. 12 shows a still further modification of the present invention wherein the device shown in FIG. 9 is shown in the ear canal of the user, with a laser replacing the coil, and the laser activating a photovoltaic receptor and driver.

With reference to FIG. 12, a still further embodiment of the present invention is illustrated. The sound processor assembly 136 is shown in the ear canal 156. The coil 148 has been replaced with a laser 170 which is directed toward a photovoltaic cell 172 and driver 174 mounted to the eardrum of the user of the device.

As described above, all of these types of devices use an ear mold or shell 137 to fit in the ear canal 156 and support the coil 148. The ear mold shell 137 is shaped to fit exactly in the ear canal and hold the coil 148 in the predetermined design location. The manufacturing process used for making shells is similar to that used for manufacturing in-the-canal hearing aids.

One technique is to make an ear mold of the ear canal using a soft impression material. A reverse impression of this mold is then made by casting the ear mold in silicone and removing it once the silicone has hardened. The void which is left is the reverse impression of the ear mold. It is then filled with a biocompatible polymer which is liquid when poured into the mold, but becomes hard and rigid after curing in the mold. This is known as a casting process.

Two component acrylic polymers are typically used since they are flowable liquids when first mixed together, and then cure at room temperature to a rigid state. Other biocompatible polymers may be also used. Single component biocompatible polymers that cure to a rigid form at elevated temperatures or when exposed to UV light or other techniques known to those skilled in the art may also be used. These polymers fall under the class of thermosetting plastics.

A thermosetting plastic, also known as a thermoset, is a polymer material that irreversibly cures. The cure may be done through heat, through a chemical reaction (two-part epoxy, for example), or irradiation such as electron beam processing. Thermoset materials are usually liquid or malleable prior to curing and designed to be molded into their final form. Once hardened, a thermoset resin cannot be reheated and melted back to a liquid form. The curing process transforms the resin into a plastic or rubber by a cross-linking process. The cross-linking process forms a molecule with a larger molecular weight, resulting in a material with a higher melting point. Uncontrolled reheating of the material results in reaching the decomposition temperature before the melting point is obtained. Therefore, a thermoset material cannot be melted and re-shaped after it is cured. Common thermosets include epoxies, polyesters, and vinylesters.

The result of this cast process is a rigid mold of the ear canal which is then used to make the in the ear shell 137. Since the cast mold is solid, material must be removed from it to create space for the electronics, coil and other desirable features such as vents. Because of the removal of material from the cast mold, this is known as a subtractive manufacturing process. The center of the mold is drilled or machined out to form a cavity which will house the electronics. This is now a shell. In addition, a hole is drilled in the shell which will hold the coil 148 in the desired location. The coil is inserted and secured in this hole. The shell 137 is then ground, polished and shaped to a smooth finish to fit comfortably in the patient's ear canal. If optimum alignment is not achieved, the second polymer portion 134 will be heated and moved, thereby moving the coil 148, until optimum alignment is achieved.

In one form, the coil 148 is connected to the external sound processor assembly by a connecting link 142, such as wire 144 or wireless link 146. In another embodiment, a faceplate 150 which has a microphone 152, switch 154, processor 138, and other electronic components attached to it, is connected to the coil 148 and then mated to the shell 137, typically by adhesive, to form the finished sound processor assembly (See FIG. 4).

A more modern technique to manufacture the shells is the use of stereolithography (SLA). Stereolithography is an additive manufacturing process. Additive manufacturing takes virtual blueprints from computer aided design (CAD) and "slices" them into digital cross-sections for the machine to successively use as a guideline for printing. Photopolymerization is primarily used in SLA to produce a solid part from a liquid. A vat of liquid photopolymer is exposed to light from an appropriate light source (i.e. DLP projector, ultraviolet laser). The exposed liquid polymer hardens. The build plate then moves down in small increments and the liquid polymer is again exposed to light. The process repeats until the model has been built. The liquid polymer is then drained from the vat, leaving the solid model. The EnvisionTec Ultra is an example of a DLP rapid prototyping system. The SLA process is well known and is used widely in rapid prototyping and low volume production, in addition to tooling applications and post-production customization.

In the SLA process, the earmold impression is digitally scanned and with the use of CAD programs and 3D printers which are well known in SLA manufacturing, a custom, rigid shell is produced of a biocompatible photopolymer. These are typically thermoset polymers which are built layer by layer such that only the material that is desired is in the final shell. This has the advantage of leaving the internal cavity open for electronics, creating desired vents and features, and producing the cylindrical hole for supporting the coil in its desired position. It also reduces manufacturing time and costs.

Methods for heating the coil support device to bend the second polymer zone 134 (if needed) include methods well known for softening thermoplastics such as heating device with hot air blower, heating device in an oven, placing the device in a heated bed of granules, heating device in a heated liquid, as well as other commonly used methods. The temperature should be selected such that the second polymer will soften and allow the coil to be moved, while the first polymer is not affected. Methods of manufacturing the coil supporting device include plastic injection molding, machining thermoplastic material, casting thermoplastic materials into a mold, and other processes typically used for shaping/molding plastics. Methods of assembling the transceiver coil or other components to the coil supporting device include insert plastic injection molding, gluing, ultrasonic welding, friction welding, solvent bonding, and other processes typically used for the assembly of small components to plastic.

Thus, by carefully studying the problems present in the field of magnetic ear devices, we have developed a new and novel method of magnet and coil alignment. It is also evident that this invention could also be used for alignment of other energy or signal transmission devices located in the ear canal that use light, lasers, ultrasound, etc., to align with a transducer in the middle ear or on the eardrum.

What is claimed is:

1. A sound processor assembly with an electromagnetic coil having an adjustable position comprising:

a) a shell made from a first polymer which is formed to the shape of an ear canal of a user to support the device, which is rigid when in use within the ear canal of the user, and which is not deformed when heated to a first temperature which softens and deforms a second polymer;

b) a coil support that is distinct from but connected to an end of the shell, the coil support being made from the second polymer which is rigid when in use within the ear canal of the user but which will soften and deform when heated to the first temperature; and c) an electromagnetic coil which is supported by and contained within the coil support.

2. The assembly defined in claim 1 where the coil support device is located in the ear canal and attached to a separate sound processor by an electric link.

3. The assembly defined in claim 2 wherein the link is a wire.

4. The assembly defined in claim 2 wherein the link is wireless.

5. The assembly defined in claim 1 where the shell contains the electronics for the sound processor.

6. A hearing implant energy transmission support device with an energy transmission device with an adjustable position comprising:

a) a shell made from a first polymer which is not deformed when heated heated to a first temperature which softens and deforms a second polymer and which is formed to the shape of an ear canal to support the device;

b) an energy transmission device support that is distinct from but connected to an end of the shell and is made from the second polymer which will deform when heated to the first temperature and is rigid when in use within the ear canal of a user and is in alignment with the shell; and c) an energy transmission device which is supported by and contained within the energy transmission device support and is axially aligned with the shell.

7. A method of manufacturing a sound processor assembly comprising the steps of:

a) manufacturing a shell from a first polymer which conforms to the ear canal of an intended user of the sound processor assembly, and which is not deformed when heated to a first temperature which softens and deforms a second polymer;

b) manufacturing a distinct coil support from the second polymer which does deform when heated to the first temperature; and c) connecting the coil support to the shell, such that the shell and the coil support are a single unit with the coil support formed at the end of the shell.

8. The method defined in claim 7, wherein the shell and the coil support are manufactured as two separate units and joined together.

9. A method of achieving an optimal alignment of a linked sound processor assembly comprising the steps of:

a) providing a shell made from a first polymer which conforms to the ear canal of an intended user of the sound processor assembly, and which is not deformed when heated to a first temperature which softens and deforms a second polymer;

b) providing a distinct coil support made from the second polymer which is rigid when in use within the ear canal of the user but does deform when heated to the first temperature and which is formed at one end of the shell;

c) calculating the optimum alignment;

d) placing the shell and coil support in the ear of the user;

e) checking to see if the optimum alignment has been achieved; and f) if the optimum alignment has not been achieved, heating the coil support and bending it as needed to obtain the best possible and/or the optimum alignment.

10. A method of achieving an optimal alignment of an integrated sound processor assembly comprising the steps of:

a) providing a shell made from a first polymer which conforms to the ear canal of an intended user of the sound processor assembly, and which is not deformed when heated to a first temperature which softens and deforms a second polymer, the shell formed as a single unit with a coil support made from the second polymer which is rigid when in use within the ear canal of the user but does deform when heated to the first temperature, wherein the coil support is formed at one end of the shell;

b) calculating the optimum alignment;

c) placing the shell and coil support in the ear of the user;

d) checking to see if the optimum alignment has been achieved; and e) if the optimum alignment has not been achieved, heating the coil support to the first temperature and bending it as needed to obtain the best possible and/or the optimum alignment.

11. A sound processor assembly with adjustable electromagnetic coil comprising:

a) a shell formed to the ear canal to support the sound processor assembly, wherein the shell is made from a first polymer, wherein the first polymer is rigid and will not deform when heated to a first temperature which softens and deforms a second polymer;

b) a distinct coil support, wherein the support is made from the second polymer and wherein, in a first state, the second polymer is rigid and will not deform, and wherein, in a second state, the second polymer is not rigid and will deform, thereby allowing the coil support to be moved when in the second state, wherein the second polymer can change between the first state and the second state upon the heating of the second polymer to the first temperature, and wherein the second polymer can change between the second state and the first state upon cooling; and c) an electromagnetic coil which is supported by and within the coil support.

12. The assembly of claim 1, wherein the coil support has a first position in relation to the shell before alignment and a second position in relation to the shell after alignment.

13. The assembly of claim 1, wherein the second polymer comprises a thermoplastic.

14. The assembly of claim 13, wherein the first polymer comprises a thermoset.

15. The assembly of claim 11, wherein the first polymer comprises a thermoset and the second polymer comprises a thermoplastic.

* * * * *